United States Patent [19]

Grisham et al.

[11] Patent Number: 4,949,771

[45] Date of Patent: Aug. 21, 1990

[54] STEEL SECURITY DOOR FRAME

[76] Inventors: Fred A. Grisham, 4130 Bartlett Country Rd., Bartlett, Tenn. 38134; C. Lynwood Grisham, 9016 Anderton Springs Dr., Memphis, Tenn. 38133

[21] Appl. No.: 365,223

[22] Filed: Jun. 12, 1989

Related U.S. Application Data

[63] Continuation of Ser. No. 21,416, Mar. 4, 1987, abandoned.

[51] Int. Cl.[5] ..... A47H 1/00

[52] U.S. Cl. ..... 160/90; 49/504

[58] Field of Search ..... 160/90, 89; 49/504, 49/63

[56] References Cited

U.S. PATENT DOCUMENTS 3,086,628 4/1963 Robinson ..... 160/90 X 4,311,183 1/1982 Herbst et al. ..... 160/90 X

*Primary Examiner*—Blair M. Johnson

*Attorney, Agent, or Firm*—Walker & McKenzie

[57] ABSTRACT

A steel security door frame including a top frame member; a bottom frame member; a first side frame member; and a second side frame member. Each of the frame members include front and rear sections made up of diverse elements to form specific panel arrangements and trackways including a guideway for slidably receiving a movably glass panel and for allowing the movable glass panel to be moved between open and closed positions. Each of the front and rear sections are bent from sheet steel.

3 Claims, 6 Drawing Sheets

STEEL SECURITY DOOR FRAME

CROSS-REFERENCE TO RELATED APPLICATION

This is a continuation-in-part of pending application Ser. No. 07/021,416, filed Mar. 4, 1987 now abandoned, entitled "STEEL SECURITY DOOR FRAME AND METHOD OF CONSTRUCTING."

BACKGROUND OF THE INVENTION

1. Field of the Invention: The present invention relates to steel security door frames.

2. Description of the Related Art: Heretofore, many steel security doors have been developed for being swingably attached on the exterior side of an exterior doorway. Such security doors generally include a steel door frame and one or more glass panels fixedly attached to the steel door frame.

While it is known to construct aluminum doors with one fixed glass panel, one fixed screen panel and one slidable glass panel for movement between a closed position in which the screen panel is blocked and an open position in which the screen panel is open to allow fresh air to pass therethrough, steel security doors with such "self-storing" slidable panels have not heretofore been available. Thus, present steel security doors with an "openable" screen panel have a fixed screen panel and a glass panel attached to the fixed screen panel with screws or the like whereby the user must completely remove the glass panel from the door frame in order to "open" the screen panel and allow air to pass through the screen panel.

Robinson, U.S. Pat. No. 3,086,628 discloses a combination storm and screen door having an extruded aluminum frame. Herbst et al., U.S. Pat. No. 4,311,183 discloses a combination storm and screen self storing door having a molded plastic frame.

None of the above prior art discloses or suggests the present invention. For example, none of the above prior art discloses or suggests a steel security door frame having steel frame members comprising diverse front and rear sections forming specific panel arrangements and trackways, etc.

SUMMARY OF THE INVENTION

The present invention is directed toward providing an improved steel security door frame.

One object of the present invention is to provide a steel security door with at least one slidable panel.

Another object of the present invention is to provide a steel security door with at least one fixed screen panel, at least one fixed glass panel, and at least one slidable glass panel movable between a first position blocking the screen panel and a second position allowing air to pass through the screen panel.

The steel security door frame of the present invention includes an elongated steel horizontal top frame member; an elongated steel horizontal bottom frame member; an elongated steel vertical first side frame member; and an elongated steel vertical second side frame member. Each of the frame members includes diverse front and rear sections, the front and rear sections being attached to one another in a manner to form a guideway for slidably receiving the movable glass panel and for allowing the movable glass panel to be moved between open and closed positions; each of the front sections being bent from sheet steel to form a first panel having a first end and a second end, a second panel attached to the first end of the first panel at a right angle thereto and extending rearwardly thereof, a third panel attached to the second end of the first panel at a right angle thereto and extending rearwardly thereof and substantially parallel with the second panel, a fourth panel attached to the third panel at the end thereof opposite the first panel and extending at a right angle to the third panel in a direction toward the second panel, a fifth panel attached to the fourth panel at the end thereof opposite the third panel and extending at a right angle to the fourth panel in a direction rearwardly of the first panel, a sixth panel attached to the fifth panel at the end thereof opposite the fourth panel and extending at a right angle to the fifth panel in a direction toward the second panel, and a seventh panel attached to the sixth panel at the end thereof opposite the fifth panel and extending at a right angle to the sixth panel in a direction rearwardly of the first panel; each of the rear sections being bent from sheet steel to form a first panel having a first end and a second end, a second panel attached to the first end of the first panel at a right angle thereto and extending forwardly thereof, a third panel attached to the second end of the first panel at a right angle thereto and extending rearwardly thereof and substantially parallel with the second panel, and a fourth panel attached to the third panel at the end thereof opposite the first panel and extending at a right angle to the third panel in a direction opposite the second panel; the second and seventh panels of the front section abutting and being attached to the second and third panels, respectively, of the rear section, thereby forming the frame member out of the diverse front and rear sections.

DESCRIPTION OF THE PREFERRED EMBODIMENTS

Figure 1:
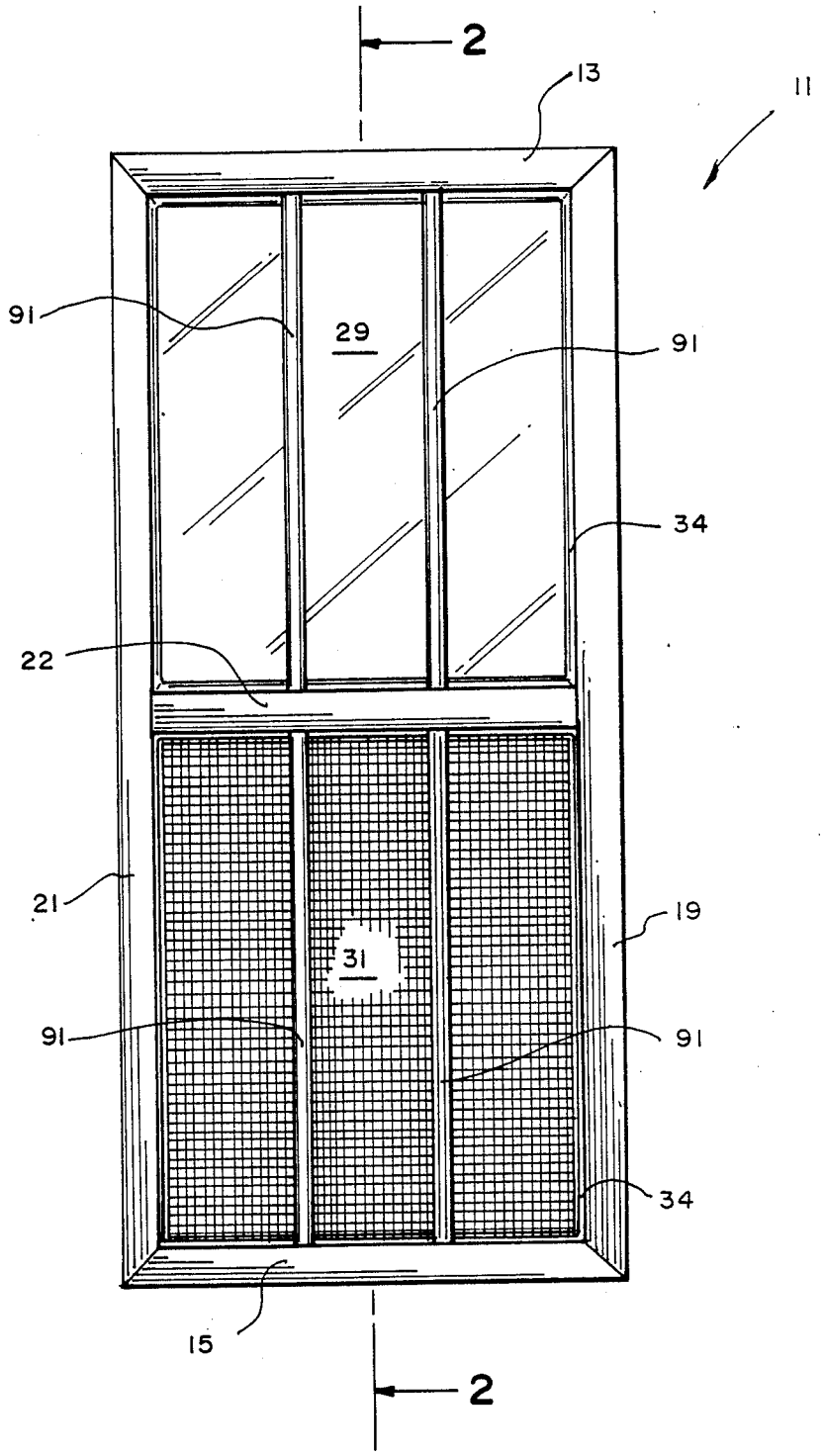
FIG. 1 is a front elevational view of the steel security door frame of the present invention.

The preferred embodiment of the steel security door frame 11 of the present invention includes, in general, an elongated steel horizontal top frame member 13, an elongated steel horizontal bottom frame member 15, an elongated steel vertical first side frame member 19, and an elongated steel vertical second side frame member 21. The door frame 11 preferably includes an elongated steel horizontal mid-frame member 22 extending between the side frame members 19, 21 substantially midway between the top and bottom frame members 13, 15.

Each frame member 13, 15, 19, 21 is a composite member. That is, each frame member 13, 15, 19, 21 is made up of diverse elements. More specifically, each frame member 13, 15, 19, 21 includes diverse front and rear sections. A first embodiment of the front and rear sections is shown in FIGS. 2–5 with the front sections identified by the numeral 23 and with the rear section identified by the numeral 25. A second embodiment of the front and rear sections is shown in FIGS. 9–18 with the front section identified by the numeral 2.23 and with the rear section identified by the numeral 2.25. Each frame member 13, 15, 19, 21 has a longitudinal guideway or track formed therein.

Figure 2:
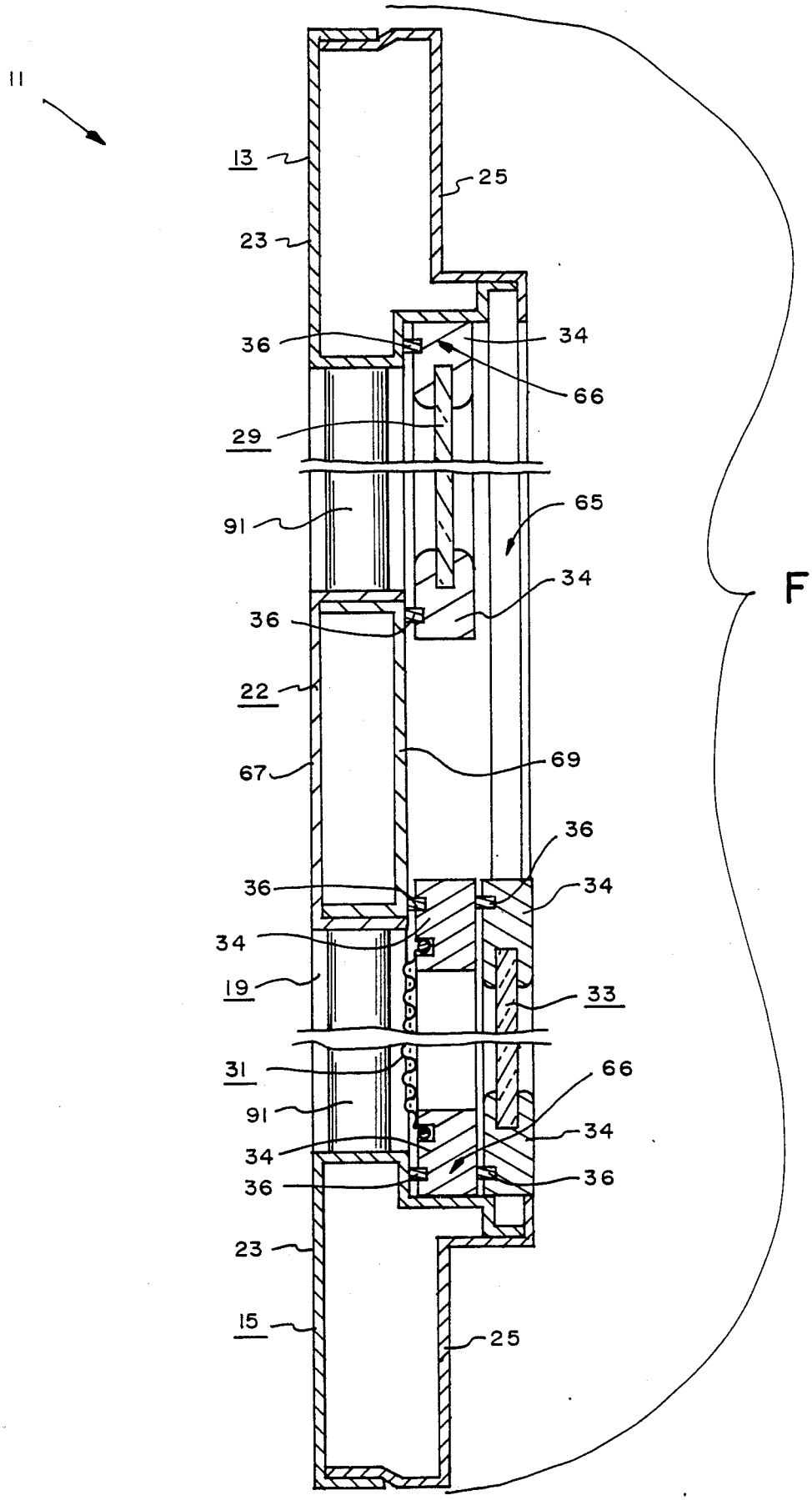
FIG. 2 is an enlarged sectional view substantially as taken on line II—II of FIG. 1 with portions thereof broken away for clarity showing a first embodiment of front and rear sections of the top and bottom frame members of the steel security door frame of the present invention.

The door frame 11 is for use with a fixed glass panel 29, a fixed screen panel 31 and a movable glass panel 33. It should be noted that the term "glass" is used herein in a broad context so as to include various plastic substances such as "Plexiglass", and the like, in addition to pure glass. Each panel 29, 31, 33 may include a typical frame 34 or the like about its outer edge as will now be apparent to those skilled in the art. The screen panel 31 may include a screen portion attached to the frame 34 thereof in any typical manner now apparent to those skilled in the art. The movable glass panel 33 slidably coacts with the guideways of the frame members 13, 15, 19, 21 to allow the movable glass panel 33 to be moved between a closed position covering the fixed screen panel 31 and an open position allowing air to pass through the screen member 31. Typical adjustment means (not shown) are preferably provided to allow the movable glass panel 33 to be fixed in various intermediate positions between the fully closed position and the fully opened position as will now be apparent to those skilled in the art. Thus, the movable glass panel 33 may be provided with typical fingers, and the like, (not shown) for extending into the guideways to slidably secure the movable glass panel 33 to the door frame 11 in a manner as will now be apparent to those skilled in the art. The adjustment means, fingers, and the like, may be similar in construction and operation to like structure in aluminum screen doors and storm windows, etc., as will now be apparent to those skilled in the art. The fixed glass panel 29 may be attached to the door frame 11 above the mid-frame member 22 with the bottom of the fixed glass panel 29 contacting the mid-frame member 22 as shown in FIG. 2. The fixed screen panel 31 may be attached to the door frame 11 below the mid-frame member 22 with the top of the fixed screen member 31 contacting the mid-frame member 22 as shown in FIG. 2. The fixed glass and screen panels 29, 31 may be attached to the door frame 11 in any manner now apparent to those skilled in the art such as with standard clip assemblies or the like (not shown). Weatherstripping 36 or the like may be attached to each panel 29, 31, 33 in any manner now apparent to those skilled in the art (see FIG. 2).

The method of constructing the door frame 11 includes, in general, the steps of forming each frame member 13, 15, 19, 21 out of steel, securing the front and rear sections 23, 25 of each frame member 13, 15, 19, 21 to one another, securing each frame member 13, 15, 19, 21 to one another to form a generally open rectangular steel door frame 11 with an integral guideway for slidably receiving a movable glass panel 33 for allowing the movable glass panel 33 to be moved between open and closed positions.

Figure 3:
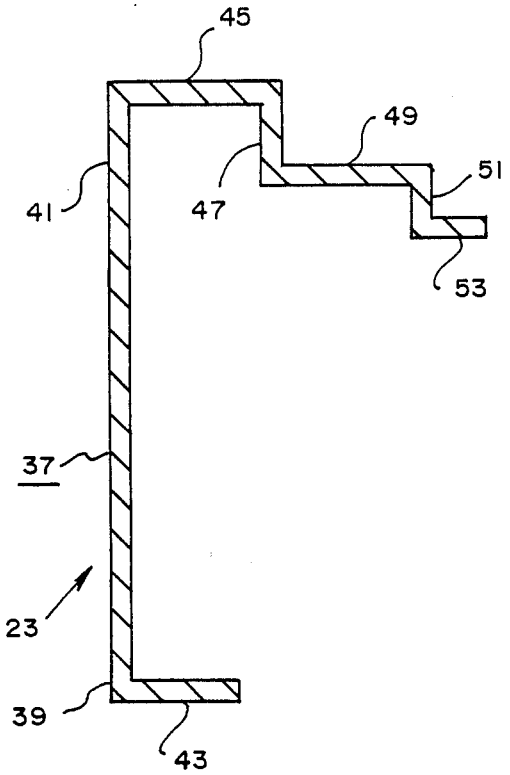
FIG. 3 is a sectional view of the first embodiment of the front section of the bottom frame member of the steel security door frame of the present invention.

The front section 23 of each frame member 13, 15, 19, 21 is preferably identical to one another and is preferably formed out of sheet steel on a typical brake or the like with a cross sectional shape as clearly shown in FIG. 3 having a first or face panel 37 with a first end 39 and a second end 41, a second panel 43 attached to the first end 39 of the first panel 37 at a right angle thereto and extending rearwardly thereof, a third panel 45 attached to the second end 41 of the first panel 37 at a right angle thereto and extending rearwardly thereof and substantially parallel with the second panel 43, a fourth panel 47 attached to the third panel 45 at the end thereof opposite the first panel 37 and extending at a right angle to the third panel 45 in a direction toward the second panel 43, a fifth panel 49 attached to the fourth panel 47 at the end thereof opposite the third panel 45 and extending at a right angle to the fourth panel 47 in a direction rearwardly of the first panel 37, a sixth panel 51 attached to the fifth panel 49 at the end thereof opposite the fourth panel 47 and extending at a right angle to the fifth panel 49 in a direction toward the second panel 43, and a seventh panel 53 attached to the sixth panel 51 at the end thereof opposite the fifth panel 49 and extending at a right angle to the sixth panel 51 in a direction rearwardly of the first panel 37.

Figure 4:
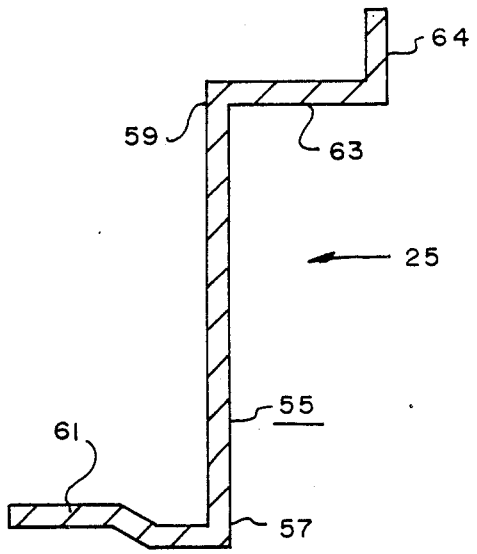
FIG. 4 is a sectional view of the first embodiment of the rear section of the bottom frame member of the steel security door frame of the present invention.

The rear section 25 of each frame member 13, 15, 19, 21 is preferably identical to one another and is preferably formed out of sheet steel on a typical brake or the like with a cross sectional shape as clearly shown in FIG. 4 having a first or back panel 55 with a first end 57 and a second end 59, a second panel 61 attached to the first end 57 of the first panel 55 at a right angle thereto and extending forwardly thereof, a third panel 63 attached to the second end 59 of the first panel 55 at a right angle thereto and extending rearwardly thereof and substantially parallel with the second panel 61, and a fourth panel 64 attached to the third panel 63 at the end thereof opposite the first panel 55 and extending at a right angle to the third panel 63 in a direction opposite the second panel 61.

Figure 5:
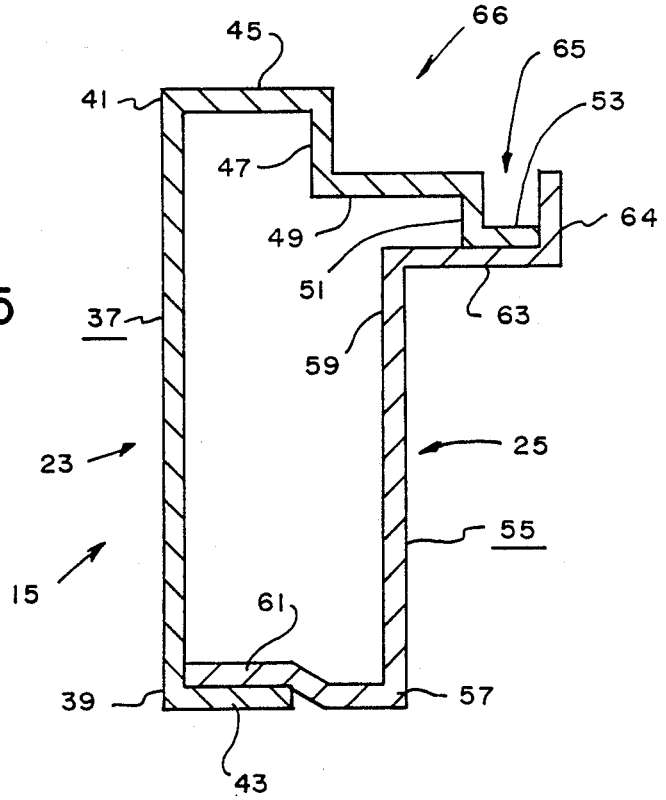
FIG. 5 is a sectional view of the front and rear sections of FIGS. 3 and 4 shown attached to one another.

The front and rear sections 23, 25 are sized so that the rear section 25 will fit into the front section 23 with second panel 61 of the rear section 25 engaging the inside portion of the second panel 43 of the front section 23 and with the third panel 63 of the rear section 25 contacting the seventh panel 53 of the front section 23 as shown in FIG. 5. The front and rear sections 23, 25 are then welded or otherwise securely attached to one another to form an integral unit (see FIG. 5) with the sixth and seventh panels 51, 53 of the front section 23 and the fourth panel 64 of the rear section 25 forming an integral guideway or track 65 for slidably receiving the movable glass panel 33 and with the fourth and fifth panel 47, 49 of the front section 23 forming an offset 66 for receiving the fixed glass and screen panels 29, 31 as shown in FIG. 2.

Figure 9:
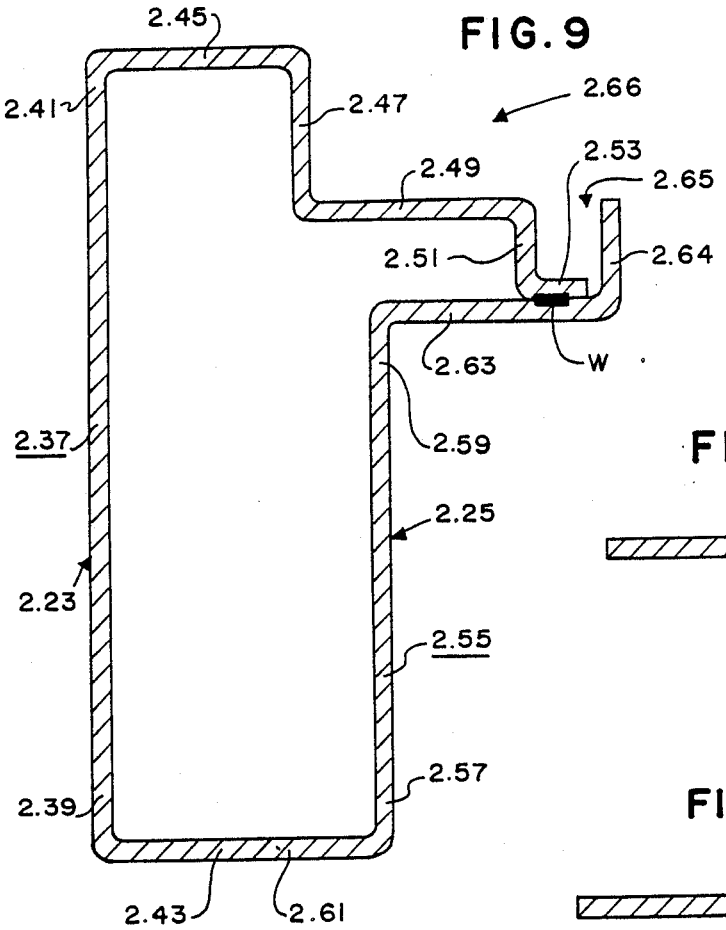
FIG. 9 is a sectional view of a second embodiment of the front and rear sections of a frame member of the steel security door frame of the present invention shown attached to one another.
Figure 10:
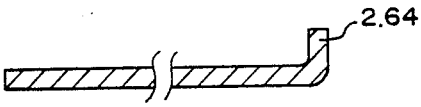
FIG. 10 is a somewhat diagrammatic sectional view of the frame member of FIG. 9 showing a first step in the manufacture thereof.
Figure 11:
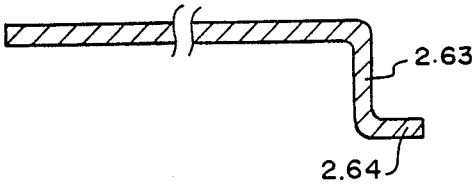
FIG. 11 is a somewhat diagrammatic sectional view of the frame member of FIG. 9 showing a second step in the manufacture thereof.
Figure 12:
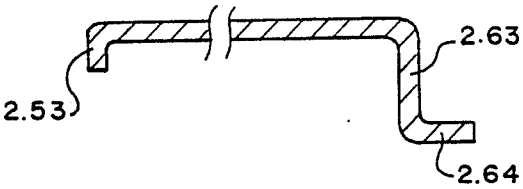
FIG. 12 is a somewhat diagrammatic sectional view of the frame member of FIG. 9 showing a third step in the manufacture thereof.
Figure 13:
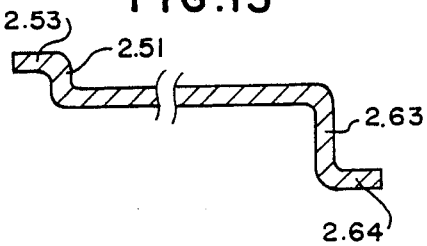
FIG. 13 is a somewhat diagrammatic sectional view of the frame member of FIG. 9 showing a fourth step in the manufacture thereof.
Figure 14:
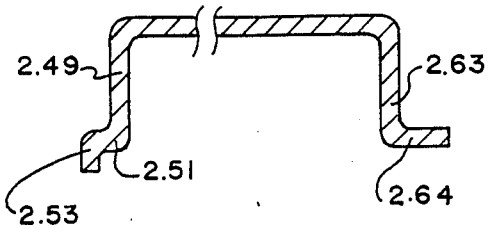
FIG. 14 is a somewhat diagrammatic sectional view of the frame member of FIG. 9 showing a fifth step in the manufacture thereof.
Figure 15:
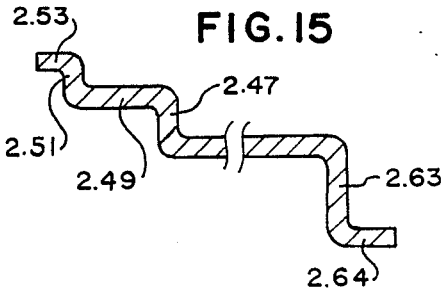
FIG. 15 is a somewhat diagrammatic sectional view of the frame member of FIG. 9 showing a sixth step in the manufacture thereof.
Figure 16:
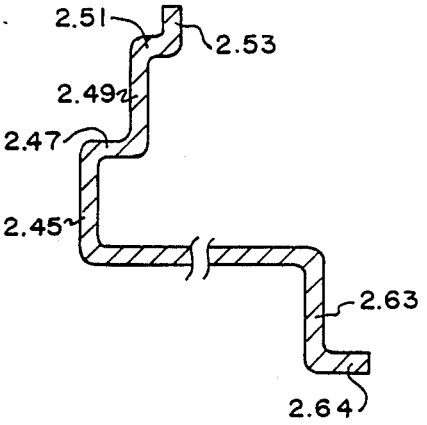
FIG. 16 is a somewhat diagrammatic sectional view of the frame member of FIG. 9 showing a seventh step in the manufacture thereof.
Figure 17:
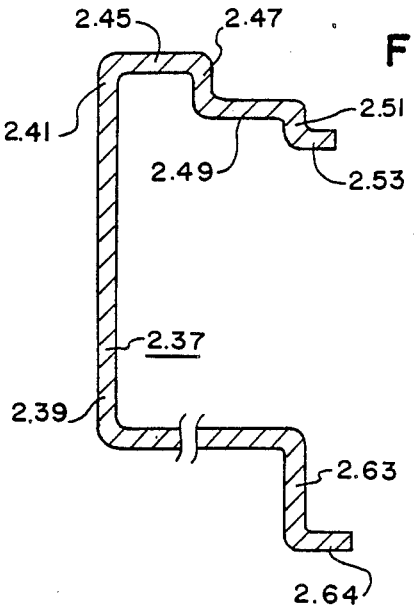
FIG. 17 is a somewhat diagrammatic sectional view of the frame member of FIG. 9 showing an eighth step in the manufacture thereof.

The front section 2.23 of each frame member 13, 15, 19, 21 is preferably identical to one another and is preferably formed out of sheet steel on a typical brake or the like with a cross sectional shape as clearly shown in FIG. 9 having a first or face panel 2.37 with a first end 2.39 and a second end 2.41, a second panel 2.43 attached to the first end 2.39 of the first panel 2.37 at a right angle thereto and extending rearwardly thereof, a third panel 2.45 attached to the second end 2.41 of the first panel 2.37 at a right angle thereto and extending rearwardly thereof and substantially parallel with the second panel 2.43, a fourth panel 2.47 attached to the third panel 2.45 at the end thereof opposite the first panel 2.37 and extending at a right angle to the third panel 2.45 in a direction toward the second panel 2.43, a fifth panel 2.49 attached to the fourth panel 2.47 at the end thereof opposite the third panel 2.45 and extending at a right angle to the fourth panel 2.47 in a direction rearwardly of the first panel 2.37, a sixth panel 2.51 attached to the fifth panel 2.49 at the end thereof opposite the fourth panel 2.47 and extending at a right angle to the fifth panel 2.49 in a direction toward the second panel 2.43, and a seventh panel 2.53 attached to the sixth panel 2.51 at the end thereof opposite the fifth panel 2.49 and extending at a right angle to the sixth panel 2.51 in a direction rearwardly of the first panel 2.37.

The rear section 2.25 of each frame member 13, 15, 19, 21 is preferably identical to one another and is preferably formed out of sheet steel on a typical brake or the like with a cross sectional shape as clearly shown in FIG. 9 having a first or back panel 2.55 with a first end 2.57 and a second end 2.59, a second panel 2.61 attached to the first end 2.57 of the first panel 2.55 at a right angle thereto and extending forwardly thereof, a third panel 2.63 attached to the second end 2.59 of the first panel 2.55 at a right angle thereto and extending rearwardly thereof and substantially parallel with the second panel 2.61, and a fourth panel 2.64 attached to the third panel 2.63 at the end thereof opposite the first panel 2.55 and extending at a right angle to the third panel 2.63 in a direction opposite the second panel 2.61.

Figure 18:
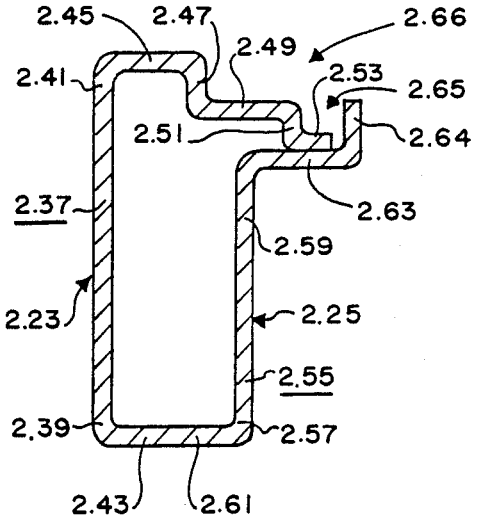
FIG. 18 is a somewhat diagrammatic sectional view of the frame member of FIG. 9 showing a ninth step in the manufacture thereof.

The front and rear sections 2.23, 2.25 are preferably formed as a integral, one-piece unit out of a single length of sheet steel as clearly shown in FIGS. 9–18 with second panel 2.61 of the rear section 2.25 and the second panel 2.43 of the front section 2.23 abutting one another as shown in FIGS. 9 and 18 and with the third panel 2.63 of the rear section 2.25 contacting the seventh panel 2.53 of the front section 2.23 as shown in FIGS. 9 and 18. While the composite front and rear sections 2.23, 2.25 may be formed in various manners, FIGS. 10–18 illustrate a series of steps using a typical brake or the like by which the diverse front and rear sections 2.23, 2.25 may be bent out of a single, integral length of sheet steel as will now be apparent to those skilled in the art. Once bent to the shape shown in FIG. 18, the third panel 2.63 of the rear section 2.25 and the seventh panel 2.53 of the front section 2.23 may be secured to one another via a spot weld W or the like as shown in FIG. 9 to form an integral unit with the sixth and seventh panels 2.51, 2.53 of the front section 2.23 and the fourth panel 2.64 of the rear section 2.25 forming an integral guideway or track 2.65 for slidably receiving the movable glass panel 33 and with the fourth and fifth panel 2.47, 2.49 of the front section 2.23 forming an offset 2.66 for receiving the fixed glass and screen panels 29, 31 as will now be apparent to those skilled in the art.

Figure 6:
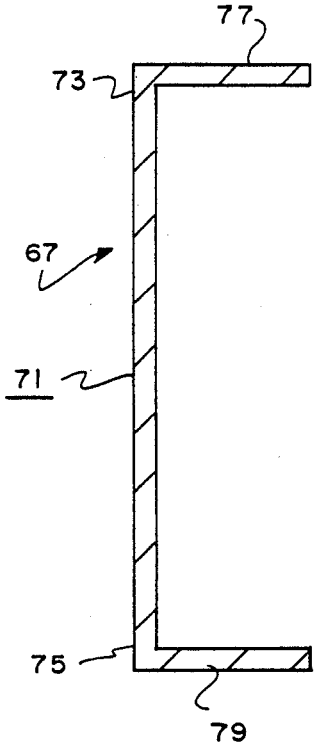
FIG. 6 is a sectional view of the front section of a mid-frame member of the steel security door frame of the present invention.
Figure 7:
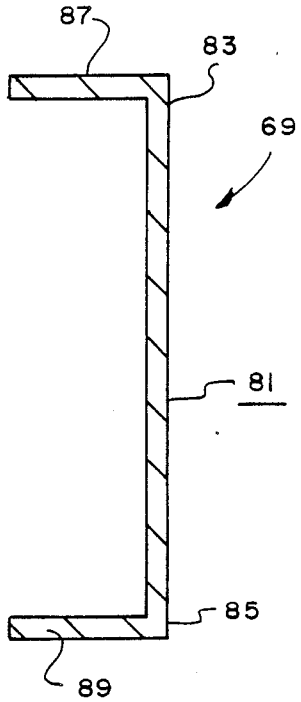
FIG. 7 is a sectional view of the rear section of the mid-frame member of the steel security door frame of the present invention.
Figure 8:
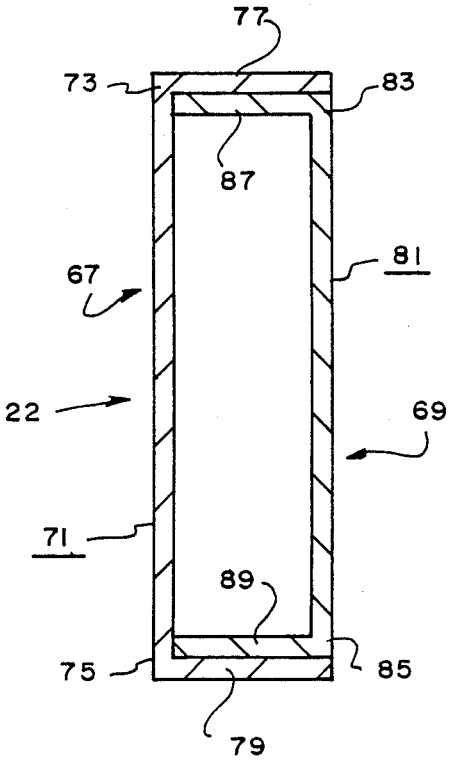
FIG. 8 is a sectional view of the front and rear sections of FIGS. 6 and 7 shown attached to one another.

The mid-frame member 22 preferably consists of an elongated steel member having a substantially rectangular cross sectional shape as clearly shown in FIG. 8. The mid-frame member 22 preferably includes a front section 67 and a rear section 69. Each section 67, 69 is preferably formed out of sheet steel on a typical brake or the like. The front section 67 is preferably formed out of sheet steel on a typical brake or the like with a cross sectional shape as clearly shown in FIG. 6 having a first or face panel 71 with a first end 73 and a second end 75, a second panel 77 attached to the first end 73 of the first panel 71 at a right angle thereto and extending rearwardly therefrom, and a third panel 79 attached to the second end 75 of the first panel 71 at a right angle thereto and extending rearwardly therefrom. The rear section 69 is preferably formed out of sheet steel on a typical brake or the like with a cross sectional shape as clearly shown in FIG. 7 having a first or back panel 81 with a first end 83 and a second end 85, a second panel 87 attached to the first end 83 of the first panel 81 at a right angle thereto and extending forwardly therefrom, and a third panel 89 attached to the second end 85 of the first panel 81 at a right angle thereto and extending rearwardly therefrom.

The front and rear sections 67, 69 are sized so that the rear section 69 will fit into the front section 67 with second and third panels 87, 89 of the rear section 69 engaging the inside portion of the second and third panels 81, 83 respectively of the front section 67. The front and rear sections 67, 69 are then welded or otherwise securely attached to one another to form an integral unit (see FIG. 8).

Once the frame members 13, 15, 19, 21, 22 are so formed, they are preferably cut to length and welded or otherwise securely attached to one another to form an open, generally rectangular frame as will now be apparent to those skilled in the art. Various other means may then be attached to the door frame 11 such as typical height adjustment means, hinge means, lock means, etc., as will now be apparent to those skilled in the art.

Steel bars 91 preferably extend between the frame members 13, 15, 22 or the like (see FIG. 1) as will now be apparent to those skilled in the art to prevent access through the panels 29, 31 of the door frame 11, etc. The opposite ends of each steel bar 91 are preferably welded to the corresponding frame member 13, 15, 22, etc.

Although the present invention has been described and illustrated with respect to a preferred embodiment and a preferred use therefor, it is not to be so limited since modifications and changes can be made therein which are within the full intended scope of the invention.

I claim:

1. A steel security door frame for use with a fixed glass panel, a fixed screen panel, and a movable glass panel; said steel security door frame comprising:

(a) an elongated steel horizontal top frame member;

(b) an elongated steel horizontal bottom frame member;

(c) an elongated steel vertical first side frame member; and (d) an elongated steel vertical second side frame member;

each of said frame members comprising a composition frame member having separate front and rear sections, said front section and rear section being manufactured separately and being attached to one another in a manner to form a guideway for slidably receiving said movable glass panel and for allowing said movable glass panel to be moved between open and closed positions; each of said front sections being bent from sheet steel to form a first panel having a first end and a second end, a second panel attached to said first end of said first panel at a right angle thereto and extending rearwardly thereof, a third panel attached to said second end of said first panel at a right angle thereto and extending rearwardly thereof and substantially parallel with said second panel, a fourth panel attached to said third panel at the end thereof opposite said first panel and extending at a right angle to said third panel in a direction toward said second panel, a fifth panel attached to said fourth panel at the end thereof opposite said third panel and extending at a right angle to said fourth panel in a direction rearwardly of said first panel, a sixth panel attached to said fifth panel at the end thereof opposite said fourth panel and extending at a right angle to said fifth panel in a direction toward said second panel, and a seventh panel attached to said sixth panel at the end thereof opposite said fifth panel and extending at a right angle to said sixth panel in a direction rearwardly of said first panel; each of said rear sections being bent from sheet steel to form a first panel having a first end and a second end, a second panel attached to said first end of said first panel at a right angle thereto and extending forwardly thereof, a third panel attached to said second end of said first panel at a right angle thereto and extending rearwardly thereof and substantially parallel with said second panel, and a fourth panel attached to said third panel at the end thereof opposite said first panel and extending at a right angle to said third panel in a direction opposite said second panel; said second and seventh panels of said front section abutting and being fastened to said second and third panels, respectively, of said rear section, thereby forming said composition frame member.

2. The steel security door of claim 1 in which said front and rear sections of each of said frame members are welded to one another to form an integral unit with said sixth and seventh panels of said front section and said fourth panel of said rear section forming an integral guideway for slidably receiving said movable glass panel and with said fourth and fifth panel of said front section forming an offset for receiving said fixed glass and screen panels.

3. A steel security door frame for use with a fixed glass panel, a fixed screen panel, and a movable glass panel; said steel security door frame comprising:

(a) an elongated steel horizontal top frame member;

(b) an elongated steel horizontal bottom frame member;

(c) an elongated steel vertical first side frame member; and (d) an elongated steel vertical second side frame member;

each of said frame members including diverse front and rear sections, said front and rear sections being attached to one another in a manner to form a guideway for slidably receiving said movable glass panel and for allowing said movable glass panel to be moved between open and closed positions; each of said front sections being bent from sheet steel to form a first panel having a first end and a second end, a second panel attached to said first end of said first panel at a right angle thereto and extending rearwardly thereof, a third panel attached to said second end of said first panel at a right angle thereto and extending rearwardly thereof and substantially parallel with said second panel, a fourth panel attached to said third panel at the end thereof opposite said first panel and extending at a right angle to said third panel in a direction toward said second panel, a fifth panel attached to said fourth panel at the end thereof opposite said third panel and extending at a right angle to said fourth panel in a direction rearwardly of said first panel, a sixth panel attached to said fifth panel at the end thereof opposite said fourth panel and extending at a right angle to said fifth panel in a direction toward said second panel, and a seventh panel attached to said sixth panel at the end thereof opposite said fifth panel and extending at a right angle to said sixth panel in a direction rearwardly of said first panel; each of said rear sections being bent from sheet steel to form a first panel having a first end and a second end, a second panel attached to said first end of said first panel at a right angle thereto and extending forwardly thereof, a third panel attached to said second end of said first panel at a right angle thereto and extending rearwardly thereof and substantially parallel with said second panel, and a fourth panel attached to said third panel at the end thereof opposite said first panel and extending at a right angle to said third panel in a direction opposite said second panel; said second and seventh panels of said front section abutting and being attached to said second and third panels, respectively, of said rear section, thereby forming said frame member out of said diverse front and rear sections.

* * * * *